US007061394B2

(12) United States Patent
Biebl

(10) Patent No.: US 7,061,394 B2
(45) Date of Patent: Jun. 13, 2006

(54) DRIVE CIRCUIT FOR AT LEAST ONE LED STRAND

(75) Inventor: Alois Biebl, Sankt Johann (DE)

(73) Assignee: Patent Treuhand Gesellschaft fur elektrische Gluhlampen mbH, Munich (DE)

( * ) Notice: Subject to any disclaimer, the term of this patent is extended or adjusted under 35 U.S.C. 154(b) by 474 days.

(21) Appl. No.: 10/457,486

(22) Filed: Jun. 10, 2003

(65) Prior Publication Data

US 2003/0227265 A1 Dec. 11, 2003

(30) Foreign Application Priority Data

Jun. 10, 2002 (DE) ..... 102 25 670

(51) Int. Cl.
*G09G 9/33* (2006.01)

(52) U.S. Cl. ..... 340/815.45; 345/48

(58) Field of Classification Search ..... 345/82–83; 315/291; 340/815.45

See application file for complete search history.

(56) References Cited

U.S. PATENT DOCUMENTS

| | | | | |
|---|---|---|---|---|
| 5,823,950 | A * | 10/1998 | Diab et al. | 600/310 |
| 5,949,225 | A * | 9/1999 | Sawtell | 323/284 |
| 6,586,890 | B1 * | 7/2003 | Min et al. | 315/224 |
| 6,724,376 | B1 * | 4/2004 | Sakura et al. | 345/204 |
| 6,825,619 | B1 * | 11/2004 | Norris | 315/149 |

FOREIGN PATENT DOCUMENTS

JP 2002203988 A * 7/2002

* cited by examiner

*Primary Examiner*—Sumati Lefkowitz
*Assistant Examiner*—Rodney Amadiz

(57) ABSTRACT

Drive circuit for at least one LED strand, with a switch being arranged in series with each LED strand and with each LED strand having a supply connection via which it can be connected to a supply voltage, in which case each switch can be driven so as to allow a current to flow in the associated LED strand, having a first control loop which is designed to drive the switch of the at least one LED strand such that an adjustable mean value is achieved for the current flowing through the LED strand, with the drive circuit also having: a second control loop which is designed to provide a supply voltage for the at least one LED strand as a function of the peak value of the current flowing through the at least one LED strand.

2 Claims, 3 Drawing Sheets

-- PRIOR ART --

DRIVE CIRCUIT FOR AT LEAST ONE LED STRAND

TECHNICAL FIELD

The present invention relates to a drive circuit for at least one LED strand, with a switch being arranged in series with each LED strand and with each LED strand having a supply connection via which it can be connected to a supply voltage, in which case each switch can be driven so as to allow a current to flow in the associated LED strand, having a first control loop which is designed to drive the switch of the at least one LED strand such that an adjustable mean value is achieved for the current flowing through the LED strand. It also relates to a method for operating at least one LED strand with a switch being arranged in series with each LED strand and each LED strand having a supply connection via which it can be connected to a supply voltage, in which case each switch can be driven so as to allow a current to flow in the associated LED strand, comprising the following steps: first of all determination of the mean value of the current flowing through the at least one LED strand and then driving of the switch for the at least one LED strand so as to achieve an adjustable mean value for the current flowing through the LED strand.

BACKGROUND ART

FIG. 1 shows a drive circuit such as this in which, by way of example, an LED strand is formed by four LEDs D1 to D4. A switch T1 is arranged at one end of the LED strand which is connected on the one hand to a control loop and on the other hand to a supply voltage $U_V$. At the other end, the LED strand is connected to ground via a shunt resistor $R_{Sh}$. The voltage $U_{Sh}$ which is dropped across the resistor $R_{Sh}$ is supplied to an integrator 10 which produces at its output a variable which corresponds to the mean value $\bar{i}_{LED}$ of the current $i_{LED}$ flowing through the LED strand. The variable $i_{LEDact}$ corresponding to the actual mean value of the current $\bar{i}_{LED}$ is supplied to an input of a comparator 12, to whose other input a variable is supplied which corresponds to a nominal value of the current $\bar{i}_{LED}$ through the LED strand, namely $\bar{i}_{LEDnom}$. The comparator 12 provides a control voltage $U_{Control}$ at its output, and this is supplied to a further comparator 14. The triangular waveform voltage $U_D$ which is produced by a triangular waveform generator 16 is applied to its second input. Its output is connected to the control input of the switch T1. The mean value $\bar{i}_{LED}$ of the current through the LED strand can be varied by varying the value $\bar{i}_{LEDnom}$, thus varying the brightness of the light which is emitted by the LEDs D1 to D4, that is to say dimming them.

This drive circuit has a number of disadvantages: for example, when an LED strand such as this is operated in a motor vehicle, it must be expected that the supply voltage $U_V$, for example the vehicle power supply system voltage, is not constant. The trimming of the number of LEDs in the LED strand must in this case be chosen so as to make it possible to achieve a sufficiently high current through the LED strand even when the supply voltage $U_V$ is at its minimum, in order to ensure a certain minimum brightness of the LEDs. If the total supply voltage is now always applied to the LED strand in order to achieve high efficiency, any increase in the supply voltage leads to an increase in the peak current flowing through the LED strand, in this context see the profiles shown by thin lines in the central illustration in FIG. 2. If, for example, the air-conditioning system in a motor vehicle is now switched on, this sudden voltage change can lead to a sudden change in the supply voltage which is available for supplying the LED strand. In the case of some LEDs, in particular in the case of InGaN-LEDs, a different peak current leads, however, to a shift in the wavelength of the light which is emitted by the LED, which can then be perceived in a disturbing manner.

A further disadvantage results from the fact that the LEDs have a negative temperature coefficient of several millivolts per degree Celsius. In this context, reference should be made to the illustration in FIG. 2, in which thick lines are used to show, by way of example, the peak current $\hat{i}_{LED}$ for various temperatures. Although the same mean value $\bar{i}_{LED}$ is always set in all three illustrations, the peak current $\hat{i}_{LED}$ varies considerably. At low temperatures, see the illustration on the left, the peak current is very much lower than at higher temperatures, see the right-hand illustration. In order to achieve the same mean value $\bar{i}_{LED}$, the LED strand is supplied in a pulsed manner, in which case the pauses between two successive pulses must be chosen to be greater at higher temperatures. However, the different peak current in turn results in an undesirable change to the wavelength of the light which is emitted by the LEDs.

Alternatively, in order to reduce the effects of fluctuations in the supply voltage and in the ambient temperature, it is possible to provide for a bias resistor to be connected upstream of the switching element. However, this results in poor efficiency. A further disadvantage is that the energy which is consumed in the bias resistor leads to a further increase in the ambient temperature, and thus exacerbates the negative effect.

DESCRIPTION OF THE INVENTION

The object of the present invention is therefore to develop a drive circuit of the type mentioned initially such that operation of the LED strand for emitting light with a desired brightness and a desired color with high efficiency can be ensured even when changes occur in the supply voltage and in the ambient temperature.

A further object of the present invention is to develop the method mentioned initially in a corresponding manner.

The first-mentioned object is achieved by a drive circuit having the features of patent claim 1. The second-mentioned object is achieved by a method having the features of patent claim 14.

The invention is based on the knowledge that the above objects can be achieved in an ideal manner if the peak value $\hat{i}_{LED}$ of the current flowing through the LED strand is determined and the supply voltage which is provided for the LED strand is regulated in an appropriate manner. Since the mean value $\bar{i}_{LED}$ of the current flowing through the LED strand is regulated, the brightness of the light which is emitted by the LEDs is kept constant in an adjustable manner. The color of the light which is emitted by the LED strand is kept constant in an adjustable manner by measuring and regulating the peak current $\hat{i}_{LED}$ flowing through the LED strand. If the supply voltage which is provided for the LED strand is then also designed such that as little energy as possible is converted into heat, this allows particularly high efficiency to be achieved. This also allows LED strands with any desired number of LEDs to be produced, that is to say when presetting the peak current it is irrelevant whether the drive circuit is used for operating an LED strand with five or ten LEDs.

In the case of LEDs, in particular in the case of InGaN-LEDs, the present invention allows the color of the light which is emitted by the LEDs to be adjusted deliberately.

Furthermore, regulating the LED peak current $\hat{i}_{LED}$ to a value which can be predetermined makes it possible to ensure that the capability of the LEDs to withstand pulsed loads is never exceeded.

The at least one LED strand is preferably operated in a pulsed manner, with the mean value of the current flowing through the at least one LED strand being adjusted, in particular, by pulse width modulation. In this case, the eye carries out the function of the integrator. As long as the LEDs are always operated with the same peak current level, only the brightness of the light which is emitted by the LEDs changes, but not its color.

The second control loop is preferably designed for particularly high efficiency for matching the supply voltage to the strand voltage of the at least one LED strand.

In a preferred development, the first and the second control loops are designed to determine the actual values for the mean value and the peak value for only a first LED strand, with an at least second LED strand being operated on the basis of the actual values determined for the first LED strand. This measure makes it possible to drive an LED array comprising two or more LED strands in order to achieve the advantages according to the invention, although the two control loops are designed only once.

The first control loop may have a first comparator which is used to compare the actual value of the mean value of the current flowing through the at least one LED strand with a nominal value which can be preset, with the output signal from the first comparator being coupled to the input of a second comparator, to whose second input a triangular waveform signal is applied, with the output signal from the second comparator being coupled to the at least one switch.

The second control loop may have a third comparator, which is used to compare the actual value of the peak value of the current flowing through the at least one LED strand with a nominal value which can be preset, with the output signal from the third comparator being coupled to the first input of a fourth comparator, to whose second input a triangular waveform signal is applied, with the output signal from the fourth comparator being coupled to a voltage converter.

For dimming purposes, it is possible to provide for the capability for an operator to vary the mean value of the current flowing through the at least one LED strand. The peak value of the current flowing through the at least one LED strand can likewise be designed such that it can be varied by an operator in order to adjust the wavelength of the light which is emitted by the LED strand.

In one preferred embodiment, the second control loop has a peak value detector for the current flowing through the at least one LED strand, in which case a peak value can be preset for the current flowing through the at least one LED strand, and the second control loop is designed to provide a supply voltage so that the peak value which can be preset is achieved. This results in the supply voltage $U_V$ being optimally matched to the LED strand voltage $U_{St}$.

The second control loop preferably has a DC/DC converter, whose output voltage is coupled to the at least one supply connection. The DC/DC converter is preferably and in particular in the form of a step-up converter, step-down converter or flyback converter. The use of a DC/DC converter allows a desired supply voltage $U_V$ to be provided in a simple manner for the LED strand in the system, thus making it possible to achieve the advantages mentioned above.

An inductance is preferably arranged in series with the output of the second control loop. This measure avoids steep rising and falling flanks in the case of clock signals, as would be the case with the circuit arrangement as is known from the prior art and as illustrated in FIG. 1. This reduces EMC problems, which is of major importance, particularly when a drive circuit according to the invention is used for motor vehicles.

Further advantageous embodiments can be found in the dependent claims.

SHORT DESCRIPTION OF THE DRAWINGS

An exemplary embodiment will now be described in more detail in the following text with reference to the attached drawings, in which.

BEST MODE FOR CARRYING OUT THE INVENTION

Figure 1:
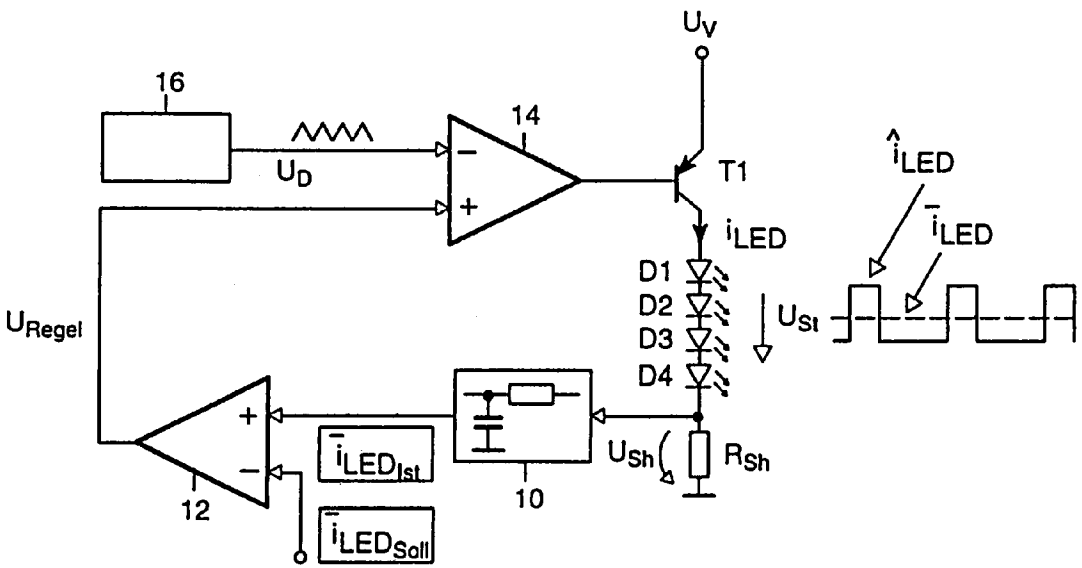
FIG. 1 shows a drive circuit, which is known from the prior art, for an LED strand.
Figure 2:
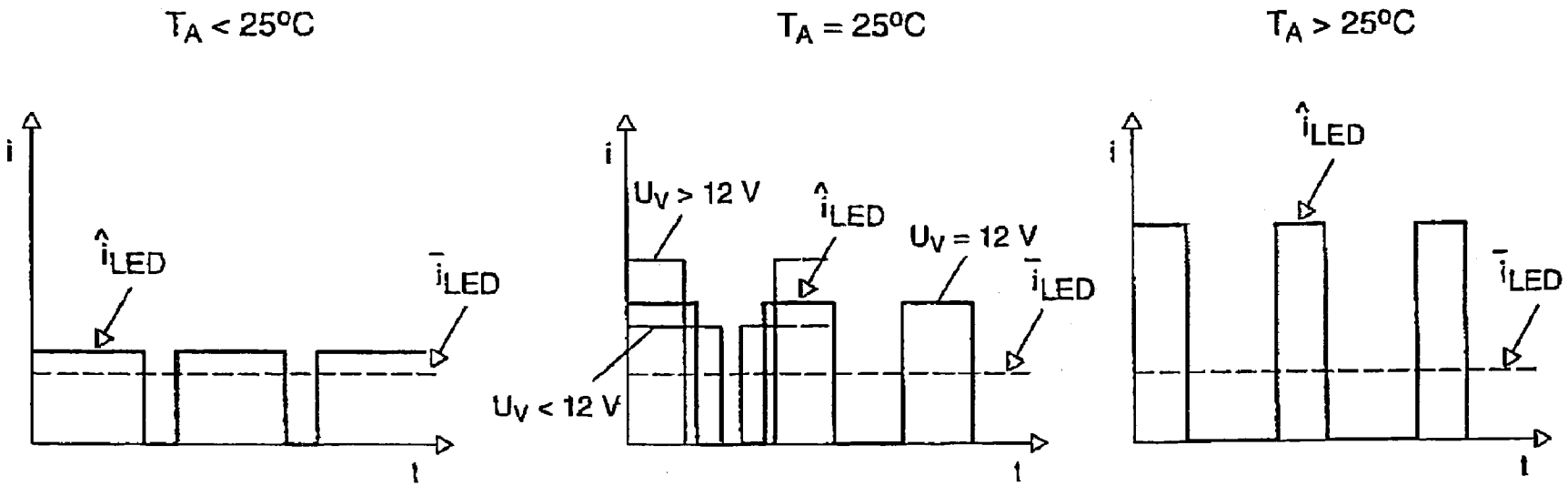
FIG. 2 shows three diagrams to explain the relationship between the peak current flowing through the LED strand and the ambient temperature and supply voltage.
Figure 3:
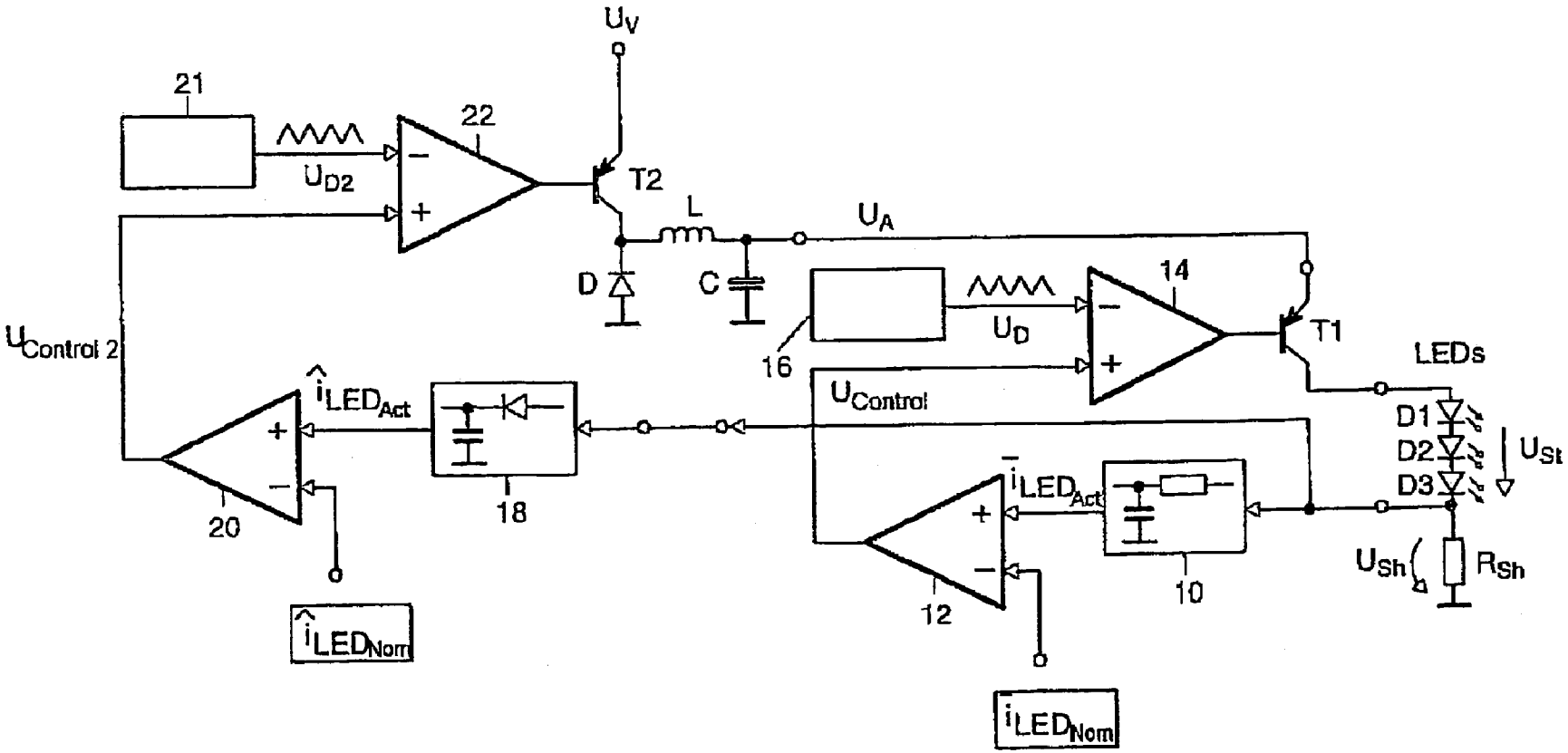
FIG. 3 shows a schematic illustration of the design of a drive circuit according to the invention.

FIG. 3 shows a drive circuit according to the invention, with the circuit component in the right-hand half of FIG. 3 corresponding essentially to the drive circuit illustrated in FIG. 1. According to the invention, the voltage $U_{Sh}$ which is dropped across the resistor $R_{Sh}$ is supplied to a peak value detector 18, whose output signal is correlated with the actual peak value $\hat{i}_{LEDact}$ and is supplied to a comparator 20. The adjustable peak value $\hat{i}_{LEDnom}$ is applied to the other input of the comparator 20. A voltage $U_{Control2}$ which corresponds to the difference between $\hat{i}_{LEDnom}$ and $\hat{i}_{LEDact}$ is supplied to a further comparator 22, whose other input is driven with a triangular waveform voltage $U_{D2}$. The output signal from the comparator 22 is applied to the control input of a switch T2, which is connected to the supply voltage $U_V$. A reverse-biased diode D is arranged between the output of the switch T2 and ground. An inductance L is arranged in series between the output of the switch T2 and the supply voltage connection of the switch T1. The connection of the inductance L on the T1 side is connected to ground via a capacitor C. The voltage $U_A$ which is provided by the capacitor C is preferably chosen such that it is essentially equal to the strand voltage $U_{St}$.

In the present case, the comparator 22, the switch T2 as well as the diode D and the triangular waveform generator 21 which produces the voltage $U_{D2}$ form a step-down converter. Other types of converters, in particular DC/DC converters, may also be provided instead of this circuit, of course, depending on the application.

The oscillator frequency of the triangular waveform generator 16 is preferably chosen to be considerably lower than the oscillator frequency of the triangular waveform generator 21, in order to allow the voltage $U_A$ to be regulated well. As will be obvious to those skilled in the art, the integrator 10 may be implemented in a different form to that sketched, that is to say other than in the form of an RC element. The peak value detector 18 may likewise be implemented in a different form than a diode/capacitor combination.

The invention claimed is:

1. A drive circuit for at least one LED strand, with a switch being arranged in series with each LED strand and with each LED strand having a supply connection via which it can be connected to a supply voltage, in which case each switch can be driven so as to allow a current to flow in the associated LED strand, having a first control loop which is designed to drive the switch of the at least one LED strand such that an adjustable mean value is achieved for the current flowing through the LED strand, characterized in that the drive circuit also has a second control loop which is designed to provide a supply voltage for the at least one LED strand as a function of the peak value of the current flowing through the at least one LED strand, wherein the first and the second control loops are designed to determine the actual values for the mean value and the peak value of only a first LED strand, with an at least second LED strand being operated on the basis of the actual values determined for the first LED strand.

2. A drive circuit for at least one LED strand, with a switch being arranged in series with each LED strand and with each LED strand having a supply connection via which it can be connected to a supply voltage, in which case each switch can be driven so as to allow a current to flow in the associated LED strand, having a first control loop which is designed to drive the switch of the at least one LED strand such that an adjustable mean value is achieved for the current flowing through the LED strand, characterized in that the drive circuit also has a second control loop which is designed to provide a supply voltage for the at least one LED strand as a function of the peak value of the current flowing through the at least one LED strand, wherein:

the second control loop has a DC/DC converter whose output voltage is coupled to the at least one supply connection, and the second control loop has a third comparator which is used to compare the actual value of the peak value of the current flowing through the at least one LED strand with a nominal value which can be preset, with the output signal from the third comparator being coupled to the first input of a fourth comparator, to whose second input a triangular waveform signal is applied, with the output signal from the fourth comparator being coupled to the DC/DC converter.

* * * * *